US011542460B2

(12) United States Patent
Piorkowski et al.

(10) Patent No.: US 11,542,460 B2
(45) Date of Patent: Jan. 3, 2023

(54) MULTI-CHAMBER DETERGENT SINGLE DOSE PACKS WITH DETACHABLE AND REATTACHABLE FUNCTIONALITY AND METHODS OF USING THE SAME

(71) Applicant: Henkel AG & Co. KGaA, Duesseldorf (DE)

(72) Inventors: Daniel Thomas Piorkowski, Fairfield, CT (US); Narcisse N. Toussa, Seymour, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 17/301,794

(22) Filed: Apr. 14, 2021

(65) Prior Publication Data

US 2022/0333047 A1 Oct. 20, 2022

(51) Int. Cl.

| | |
|---|---|
| ***C11D 17/04*** | (2006.01) |
| ***C11D 3/386*** | (2006.01) |
| ***C11D 3/43*** | (2006.01) |
| ***B65D 65/46*** | (2006.01) |

(52) U.S. Cl.

CPC ..... *C11D 17/045* (2013.01); *B65D 65/46* (2013.01); *C11D 3/386* (2013.01); *C11D 3/43* (2013.01)

(58) Field of Classification Search

None

See application file for complete search history.

(56) References Cited

U.S. PATENT DOCUMENTS

| | | | |
|---|---|---|---|
| 3,198,740 | A | 8/1965 | Dunlop et al. |
| 3,485,349 | A | 12/1969 | Chaney |
| 4,839,076 | A | 6/1989 | Willman et al. |
| 4,846,992 | A | 7/1989 | Fonsny |
| 5,160,654 | A | 11/1992 | Falou et al. |
| 5,176,275 | A | 1/1993 | Bowie |
| 5,294,361 | A | 3/1994 | Van den Brom et al. |
| 5,316,400 | A | 5/1994 | Hoyt et al. |
| 5,783,541 | A | 7/1998 | Tack et al. |
| 5,971,138 | A | 10/1999 | Soughan |
| 6,133,214 | A | 10/2000 | Jung et al. |
| 6,521,581 | B1 | 2/2003 | Hsu et al. |
| 6,863,960 | B2 | 3/2005 | Curro et al. |
| 8,069,985 | B2 | 12/2011 | Burattini |
| 2002/0086806 | A1 | 7/2002 | Giblin et al. |
| 2003/0108705 | A1 | 6/2003 | Duffield et al. |
| 2005/0003982 | A1 | 1/2005 | Beckholt |
| 2005/0119150 | A1 | 6/2005 | Pegelow et al. |
| 2006/0122088 | A1 | 6/2006 | Sadlowski et al. |

(Continued)

*Primary Examiner* — Lorna M Douyon

(74) *Attorney, Agent, or Firm* — Bojuan Deng

(57) ABSTRACT

A multi-chamber single dose pack includes a first water-soluble film, a second water-soluble film adhered to the first film, a first chamber and second chamber formed by the first film and the second film, a first detergent wash composition in the first chamber, a second detergent wash composition in the second chamber, a perforated tear line between the two chambers allowing separation of the two chambers by hand without opening either chamber, and a water-soluble adhesive disposed along an outward-facing portion of either or both of the first and second films. The water-soluble adhesive is configured to allow the attachment of at least one further chamber including a further wash composition.

20 Claims, 6 Drawing Sheets

(56) References Cited

U.S. PATENT DOCUMENTS

| | | | | |
|---|---|---|---|---|
| 2009/0249558 | A1* | 10/2009 | Fileccia | C11D 17/044 156/538 |
| 2011/0301070 | A1* | 12/2011 | Ochomogo | C11D 17/042 510/180 |
| 2012/0138654 | A1 | 6/2012 | Lee | |
| 2015/0136637 | A1* | 5/2015 | Meier | B65D 75/54 53/415 |
| 2016/0251148 | A1 | 9/2016 | Edwards | |
| 2016/0280869 | A1* | 9/2016 | Nii | C08J 5/18 |
| 2017/0096275 | A1 | 4/2017 | Geeraert et al. | |
| 2017/0247172 | A1 | 8/2017 | Edwards et al. | |
| 2018/0057776 | A1 | 3/2018 | Brandt Sanz | |
| 2018/0223229 | A1 | 8/2018 | Tan et al. | |
| 2020/0002073 | A1 | 1/2020 | Wood | |

* cited by examiner

MULTI-CHAMBER DETERGENT SINGLE DOSE PACKS WITH DETACHABLE AND REATTACHABLE FUNCTIONALITY AND METHODS OF USING THE SAME

FIELD OF THE INVENTION

The technical field relates to detergent packaged in single dose packs and methods of using the same, and more particularly relates to single dose packs provided with detergent wash compositions in multiple chambers that are attached to one another, wherein the chambers are both detachable from one another and reattachable to one another in various combinations of two, three, or more chambers, which may be different from the original pack configuration, and methods of using the same.

BACKGROUND OF THE INVENTION

Detergent wash compositions packaged in single (unit) dose packs are available for a variety of washing activities, such as clothes laundering and dish washing. The single dose pack provides a pre-measured quantity of detergent that is easy to carry and convenient to use. The single dose pack minimizes over-dosage of detergent and has proven popular with consumers. For example, the single dose pack provides the consumer with a prepared amount of agent to place in the machine, avoiding the potential for mess and/or error associated with pouring and transferring the detergent.

Many single dose packs include a wash composition that is encapsulated within a film, where the wash composition includes detergent, solvents, and other components useful for cleaning, such as enzymes. Water is one solvent often utilized in single dose packs. Propylene glycol, polyethylene glycol, and glycerin are further, non-aqueous solvents that are often utilized in single dose packs.

In some instances, there may be mismatch between the amount of detergent in a single dose pack and the load to be washed. It is not unusual for a consumer to occasionally need to wash a small load of material. In such cases, using the amount of detergent for a full load in the single dose pack may be excessive and/or wasteful. With powders and liquids, consumers could adjust the amount of detergent they provided to match the demands of the load. More detergent could be used with heavily soiled loads. Less detergent could be used with lightly soiled loads. This flexibility has not been available in single dose packs.

Moreover, there can be a mismatch between the type of detergent in a single dose pack and the type of soiling intended to be removed in the load to be washed. For example, in the context of laundry washing, some detergents may be better suited to removal of certain stains (e.g., organics such as grass and dirt) whereas other detergents may be better suited to removal of other stains (e.g., foods, oils, and fats). In such cases, using a multi-chamber pack having both detergent functionalities in separate chambers may be unnecessary in the event that the load to be washed only has one type of stain. The detergent used could thus be matched with or optimized by the consumer to the particular soiling in the load. This flexibility has also not been available in single dose packs.

Alternatively, in other instances, the load to be washed may be larger and require more detergent than available in a single dose pack. Or, the type of detergent in a particular single dose pack may not be matched with the requirements of a load that includes multiple types of stains/soiling. In such instances, the level and/or type of detergent required by the load may not be sufficiently provided by a particular single dose pack.

Accordingly, it is desirable to provide single dose packs that are scalable to the size of the intended wash load, whether by increasing or decreasing, and methods of using such single dose packs. Moreover, it is desirable to provide single dose packs that are customizable to the intended type of washing activity, such as the particular soiling to be removed in the wash load, or multiple types of soiling, and methods of using such single dose packs. Furthermore, other desirable features and characteristics will become apparent from the subsequent detailed description and the appended claims, taken in conjunction with the foregoing technical field and background.

SUMMARY OF THE INVENTION

The inventors herein have surprisingly discovered that single dose packs having multiple chambers, wherein the individual chambers are both detachable from one another and reattachable to one another in various combinations of two, three, or more chambers, which may be different from the original pack configuration, have a unique utility in their ability to match an appropriate amount of detergent with the size of the load to be washed, such as by increasing or decreasing the amount of detergent provided. Moreover, these single dose packs have the ability to match their detergent type(s) with the nature of the soiling in the load to be washed, such as by removing unnecessary detergents or by adding required detergents.

Accordingly, the present disclosure provides single dose packs exhibiting improved scalability and customizability. In one embodiment, disclosed is a multi-chamber single dose pack that includes a first water-soluble film, a second water-soluble film adhered to the first film, a first chamber and second chamber formed by the first film and the second film, a first detergent wash composition in the first chamber, a second detergent wash composition in the second chamber, a perforated tear line between the two chambers allowing separation of the two chambers by hand without opening either chamber, and a water-soluble adhesive disposed along an outward-facing portion of either or both of the first and second films. The water-soluble adhesive is configured to allow the attachment of at least one further chamber including a further wash composition.

In another embodiment, a method of preparing customized multi-chamber single dose packs includes the step of providing a single dose pack including at least one chamber containing a first detergent wash composition, wherein the at least one chamber is formed by a first film and a second film attached to each other, and a water-soluble adhesive disposed along an outward-facing portion of either or both of the first and second films. The method further includes the step of providing a supplemental detergent wash composition delivery system including a first strip of water-soluble film, a second strip of water-soluble film adhered to the first strip of water-soluble film, a plurality of compartments formed by the first and second strips of water-soluble film, the plurality of compartments containing a second detergent wash composition, and a plurality of weakened areas located between the compartments such that the weakened areas may be used to separate adjacent compartments without rupturing either adjacent compartment. Still further, the method includes the steps of detaching at least one compartment of the supplemental detergent wash composition delivery system by the weakened areas and attaching the at least one compartment to the single dose pack by pressing the at least one compartment to the single dose pack using the water-soluble adhesive disposed along the outward-facing portion of the single dose pack, thereby forming a customized multi-chamber single dose pack.

In yet another embodiment, disclosed is a multi-chamber single dose pack including a first chamber comprising a first water-soluble film, a second water-soluble film adhered to the first film, and a first detergent wash composition in the first chamber, a second chamber comprising a third water-soluble film, a fourth water-soluble film adhered to the third film, and a second detergent wash composition in the second chamber, and a water-soluble adhesive disposed along an outward-facing portion of any of the first, second, third, or fourth films, wherein the water-soluble adhesive adjoins the first chamber to the second chamber thereby forming the multi-chamber single dose pack.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

The accompanying Drawing figures illustrate various examples of the principles described herein and are a part of the specification. The illustrated examples do not limit the scope of the claims.

Figure 1A:
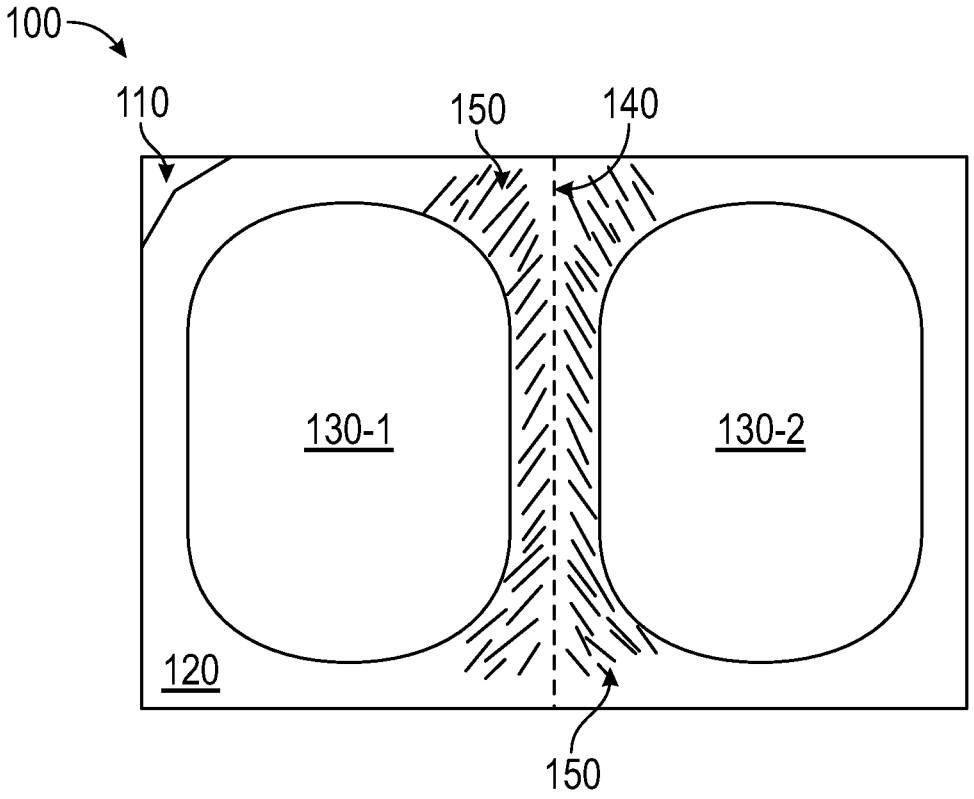
FIG. 1A shows a plan view and FIG. 1B shows a side view of an example of a multi-chamber single dose pack consistent with this specification, in a state prior to detachment.

Throughout the Drawing, identical reference numbers designate similar, but not necessarily identical, elements. The figures are not necessarily to scale, and the size of some parts may be exaggerated or minimized to more clearly illustrate the example shown. The Drawing provides examples and/or implementations consistent with the description. However, the description is not limited to the examples and/or implementations shown in the Drawing.

DETAILED DESCRIPTION

The following detailed description is merely exemplary in nature and is not intended to limit the single dose pack, or the method for producing or using the same. Furthermore, there is no intention to be bound by any theory presented in the preceding background or the following detailed description.

The term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated.

The present disclosure generally relates to single (unit) dose detergent wash compositions, contained within multi-chamber single dose packs, that realize an improved functionality in terms of scalability to the size of the wash load and customizability to the type of soil removal appropriate to the wash load. The individual chambers of the multi-chamber single dose packs are detachable from one another and also reattachable to one another in various combinations of two, three, or more chambers, which may be different from the original pack configuration. Accordingly, more of fewer chambers may be utilized, as appropriate to the size of a particular wash load. Moreover, in the event that the individual chambers contain different detergent wash compositions that are designed for particular soil removal applications, chambers may be detached where a particular soil removal functionality is not required or reattached (or added from a different single dose pack) wherein a particular soil removal functionality is desired.

Multi-Chamber Detachable/Reattachable Configuration

Figure 1B:
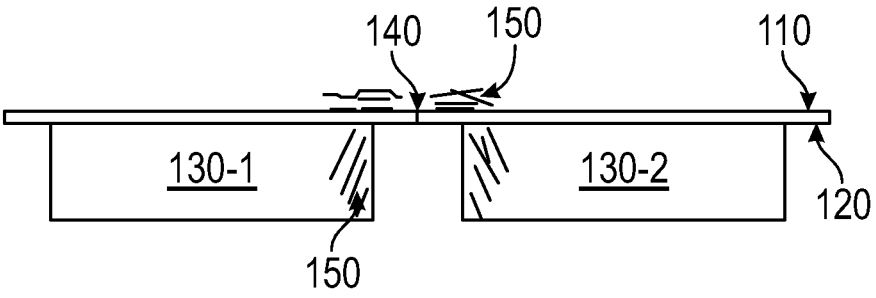

Turning now to the Drawing figures, FIG. 1A shows a plan view of an example of a multi-chamber single dose pack (100) consistent with this specification. FIG. 1B shows a side view of the pack (100) of FIG. 1A. The pack (100) of FIGS. 1A and 1B are shown in a state prior to any detachment having occurred. The pack (100) is a unit dose delivery system which includes: a first water-soluble film (110); a second water-soluble film (120) adhered to the first film; a first chamber (130-1) and second chamber (130-2) formed by the first film (110) and second film (120); a first detergent wash composition in the first chamber (130); a second detergent wash composition in the second chamber (130); and a weakened area, such as a perforated tear line (140), between the two chambers (130) allowing detachment of the two chambers (130) by hand without opening either chamber (130). It should be noted that in alternative embodiments, the weakened area may instead be provided such that the film of the weaken areas are crystalline and non-weakened areas of the water soluble film are amorphous. The pack (100) further includes a water-soluble adhesive or other tacky resin (150) disposed about one or more outward-facing portions of the periphery of the first/second films (110, 120) and/or first/second chambers (130-1, 130-2). As illustrated in FIGS. 1A and 1B, in this particular embodiment, the adhesive (150) is disposed along the outward-facing surface of the first film (110) generally abutting the tear line (140), as well as along the outward-facing surface of the second film (120) along sides of the first and second chambers (130-1, 130-2) proximate the tear line (140). Alternatively, the adhesive may be located at other portions of the films (110, 120) and/or chambers (130-1, 130-2).

The first film (110) and second film (120) form the walls of the chambers (130). The chambers (130) may have similar shapes and dimensions as shown in FIGS. 1A and 1B. The chambers (130) may have different shapes from each other. The chambers may have aesthetic and fanciful shapes, for example a detergent wash composition with a rose scent may be placed in a chamber with a rose-like shape. The detergent wash composition may be colored, for example, red or yellow, to show the color of the rose. Such shapes and colors may aid a consumer in distinguishing different wash compositions. The chamber may form a trademarked shape. The chambers (130) may include numbers, letters, and/or symbols in the first film (110) and/or second film (120). The chambers (130) may be the same depth. The chambers (130) may be of different depths (130). The chambers may include secondary, tertiary, etc. chambers to hold multiple detergent wash compositions.

In some embodiments, the first detergent wash composition may be the same as the second detergent wash composition. Such embodiments may be employed where the scalability function is desirable. As such, where a relatively smaller wash load is contemplated, the second chamber (130-2) may be detached along the tear line (140), and only the first chamber (130-1) employed for the load. Where a relatively larger wash load is contemplated, additional chambers may be attached to the pack (100) using the adhesive (150), as will be discussed in greater detail below in connection with FIGS. 5A, 5B, 6, 7A, and 7B. In other embodiments, the first wash composition and second wash composition may be different. Such embodiments may be employed where the customizability function is desirable. As such, where a wash load only has a single type of soiling that may be most properly addressed with the wash composition in the first chamber (130-1), the second chamber (130-2) may be detached along the tear line (140), and only the first chamber (130-1) employed for the load. Where a wash load has multiple types of soiling, multiple chambers may be attached together using the adhesive (150), each having a different wash composition suitable for the type(s) of soiling present, again as will be discussed in greater detail below in connection with FIGS. 5A, 5B, 6, 7A, and 7B. Of course, various combinations of utilizing chambers having both the same and different wash compositions may be employed in single dose packs having three or more chambers (as shown for example in FIGS. 7A and 7B).

The first chamber (130-1) and the second chamber (130-2) are separated by the perforated tear line (140). The perforated tear line (140) allows the first and second chambers to be separated (detached) by hand without a tool. The perforated tear line (140) should not compromise the integrity of the chambers when the perforated tear line (140) is used to separate the chambers (130). The perforated tear line may have a very low tear force. In an example, the force to tear the perforated tear line (140) is greater than 0.1 $lb_f$ and less than 5 $lb_f$. The force to tear the perforated tear line (140) may be greater than the weight of either portion of the pack (100). The force to separate may be optimized based on the expected handling of the pack (100) and the expected consumer profile. The force to separate should be high enough to keep the parts of the pack (100) together during handling, including transportation, shipping, loading, etc. The force to separate should be low enough to be readily accomplished by a wide variety of consumers without difficulty and/or effort. The use of mechanical features to concentrate the force may reduce the force used. The modification of thickness and material properties of the films may be used to change the force to separate the parts of the pack (100). The size and shape of the perforations may also be used to modify the separating force.

The perforated tear line (140) may pass through the first film (110), the second film (120), and/or both films (110, 120). In an example, the area with the perforated tear line (140) is through an area with both films (110, 120) adhered and/or joined together. In an example, one of the films is present only near the chambers (130) and is not present between the chambers (130) on the perforated tear line (140). One of the films (110, 120) may be sliced through and/or separated over the perforated tear line (140) such that the other film (110, 120) holds the parts of the pack (100) together.

Figure 2A:
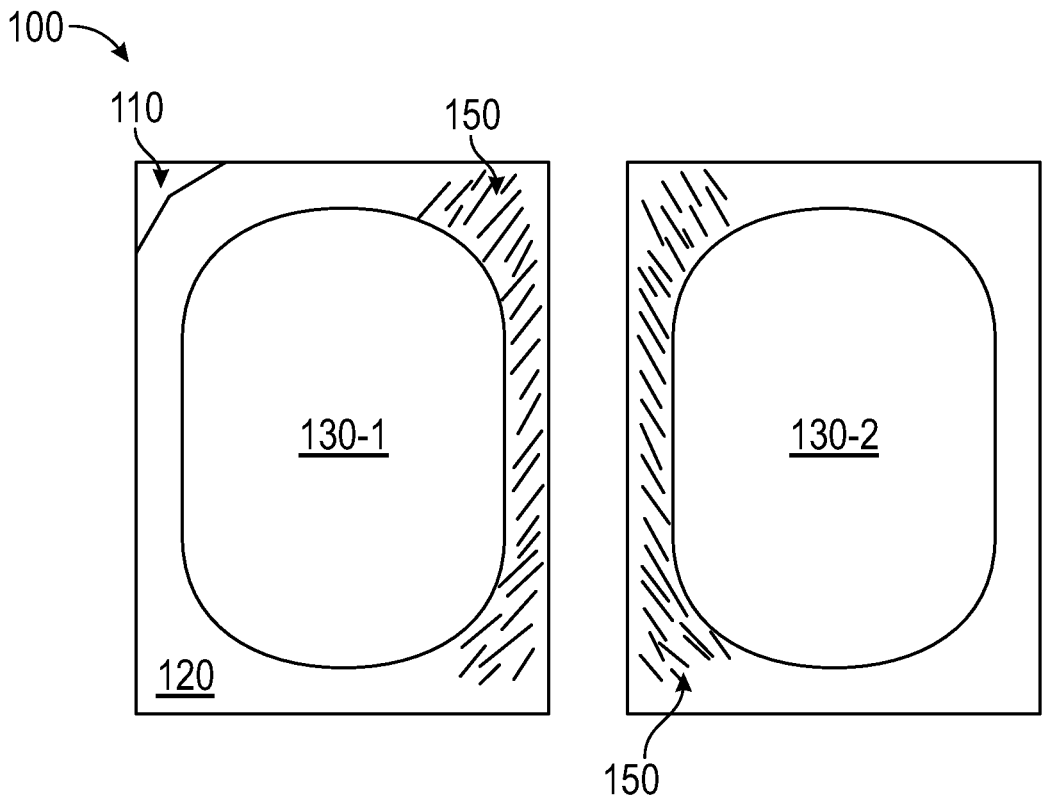
FIG. 2A shows a plan view and FIG. 2B shows a side of the example multi-chamber single dose pack of FIGS. 1A and 1B, in a state subsequent to detachment.
Figure 2B:
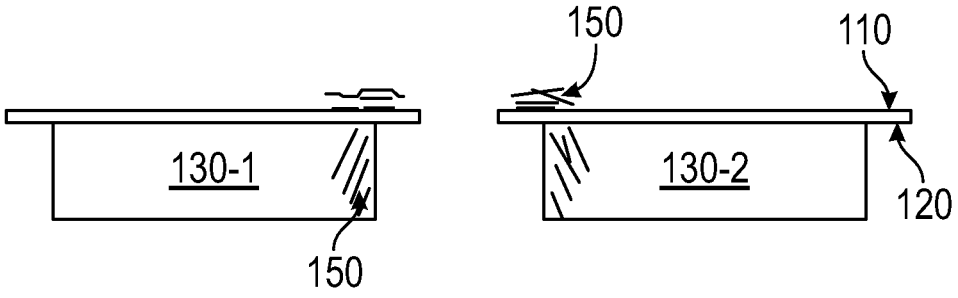

In an example, the perforated tear line (140) may have a higher force to initiate tearing and a lower force to propagate the tear. This may be a result of using non-uniform sized and/or shaped perforations. This may be the result of modifying the shape of the end perforations. This may be the result of modifying the thickness of the film (110,120) near the perforations. Having a higher initiation force may reduce accidental tears. Another approach is to increase the force as the tearing propagates. This can be accomplished by using varying size perforations and/or modifying the spacing of the perforations. Similarly, the material may be modified to make the layer thicker, thinner, harder, stiffer, softer, etc. as desired. When the chambers (130-1, 130-2) are separated along the perforated tear line (140), the chambers separate from one another, and become two individual, single-chamber, single dose packs, as illustrated in FIGS. 2A and 2B.

Water-soluble adhesive (150) should provide sufficient adhesion such that when a first chamber is reattached to a second chamber, the two chambers remain together as an integral unit (pack), which does not detach without the application of additional mechanical force. Adhesive (150) may be a pressure-sensitive adhesive such that reattachment may be accomplished by pressing one chamber to another chamber(s) at the location along the film (110, 120) where the adhesive (150) is present. The type of water-soluble adhesive (150) employed in accordance with the present disclosure is not particularly limited, other than that it should have the qualities noted above. For example, in some embodiments, the adhesive (150) may be derived from natural polymers, including but not limited to vegetable sources (e.g., dextrins, starches), protein sources (e.g., casein, blood, fish, soybean, milk albumen), and animal sources (e.g., hides, bones). In alternative embodiments, the adhesive (150) may be derived from synthetic polymers, including but not limited to polyvinyl alcohol, cellulose ethers, methylcellulose, carboxymethylcellulose, polyvinylpyrrolidone, and derivates or combinations of any of the foregoing. The amount and positioning of the adhesive (150) on a chamber may depend, for example, on the shape/configuration of the chamber, and/or the shape/configuration of other chambers to which such chamber is anticipated to be reattached.

Figure 3:
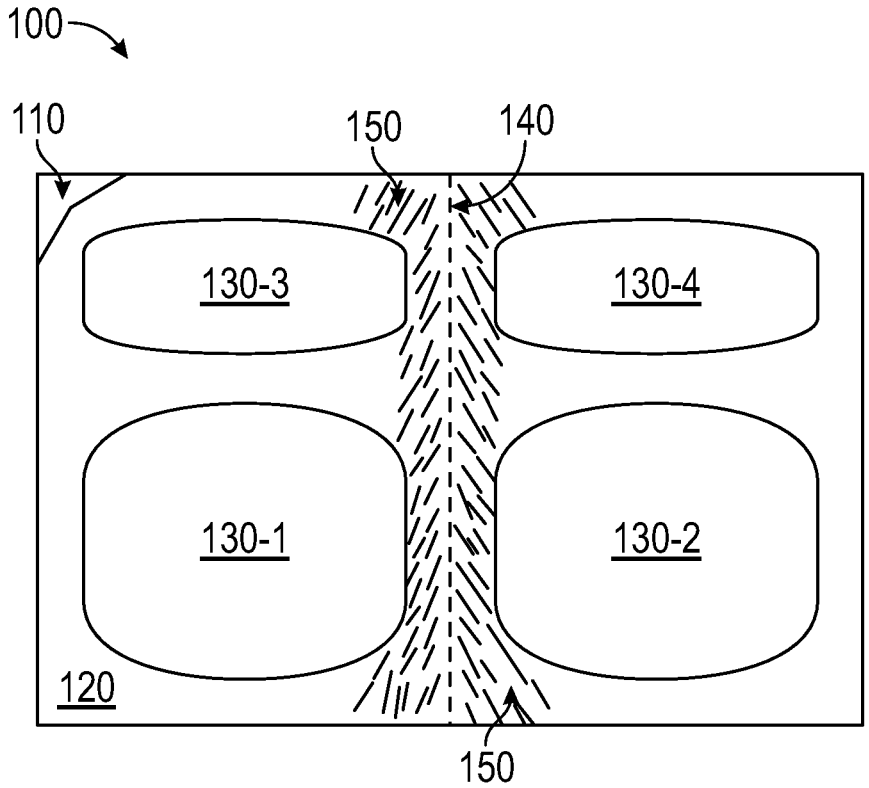
FIG. 3 shows a plan view of another example of a multi-chamber single dose pack consistent with this specification, in a state prior to detachment.
Figure 4:
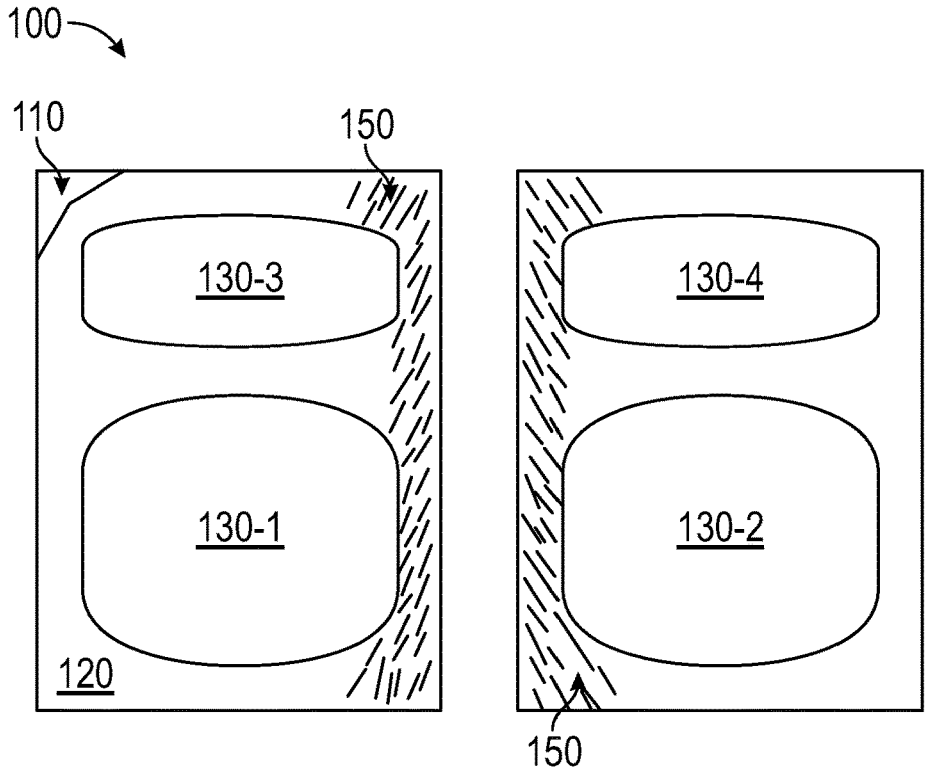
FIG. 4 shows a plan view of the example multi-chamber single dose pack of FIG. 3, in a state subsequent to detachment

FIG. 3 shows a plan view of another example of a multi-chamber single dose pack (100) consistent with this specification. The pack (100) in FIG. 3 includes a first film (110), a second film (120), four chambers (130-1. 130-2, 130-3, 130-4), perforated tear line (140) dividing the chambers into two groups, and a water-soluble adhesive or other tacky resin (150). The chambers (130) may be organized into any number of clusters, each cluster able to be separated (detached) using a perforated tear line (140). In an example, the pack (100) may be manually separated without tools and/or other equipment into two equivalent fractions. The pack (100) may be detachable into thirds, fourths, and/or other distributions, such as ⅓ and ⅔. Allowing more separations allows more flexibly in dosing scalability and in detergent wash composition type/formulation. In this embodiment as well, when the chambers (130) are separated along the perforated tear line (140), the chambers separate from one another, and become two individual, multi-chamber, single dose packs, as illustrated in FIG. 4 (i.e., a first single dose pack including chambers (130-1 and 130-3), and a second single-dose pack including chamber (130-2 and 130-4).

Figure 5A:
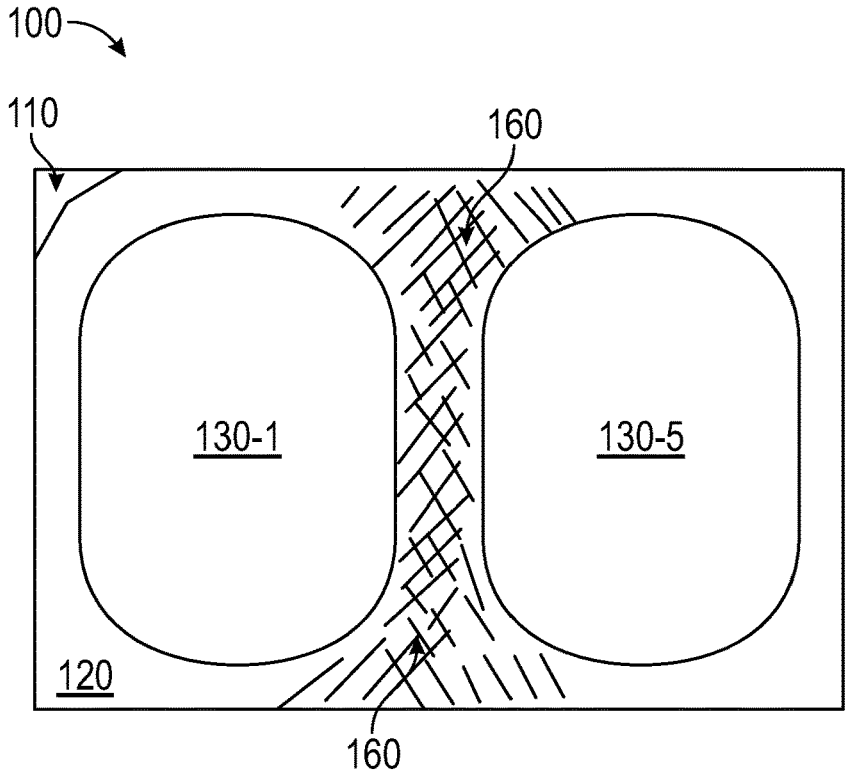
FIGS. 5A and 5B show plan and side views, respectively, of the first chamber of the multi-chamber single dose pack of FIGS. 1A and 1B, in a state subsequent to reattachment with a further chamber.
Figure 5B:
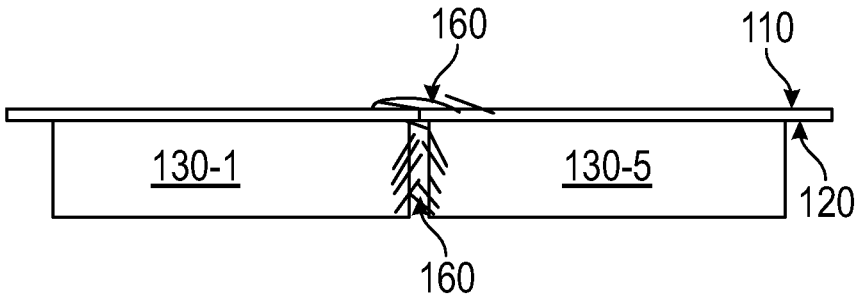
Figure 6:
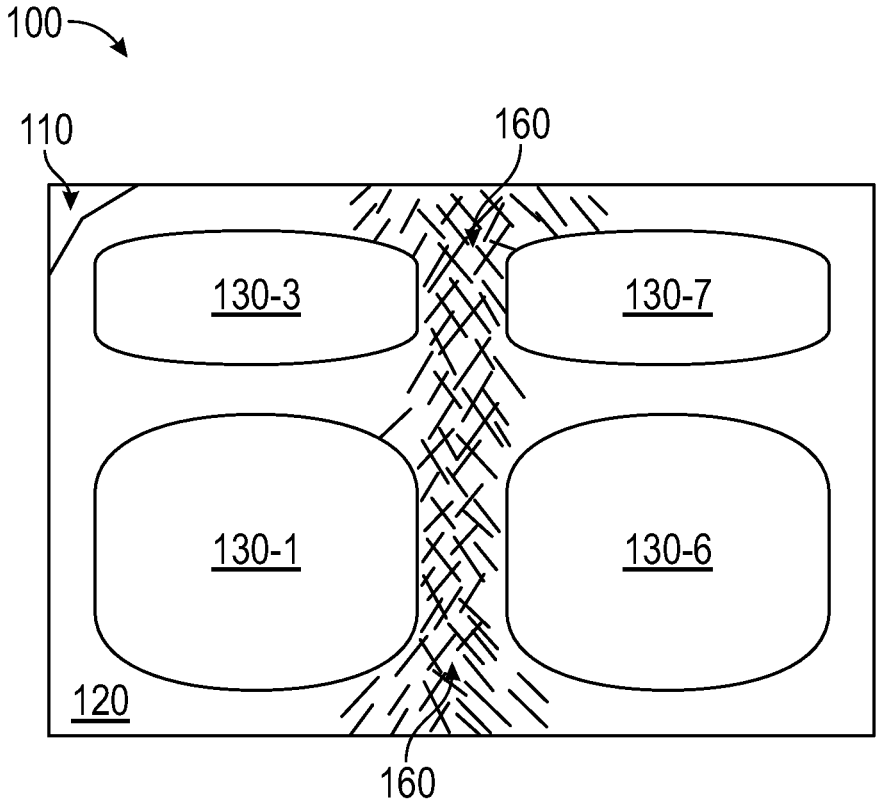
FIG. 6 shows a plan view of the first two chambers of the multi-chamber single dose pack of FIG. 3, in a state subsequent to reattachment with two further chambers.

FIGS. 5A and 5B show plan and side views, respectively, of the multi-chamber single dose pack of FIGS. 1A and 1B, in a state subsequent to reattachment with a further single dose pack 130-5, and furthermore, FIG. 6 shows a plan view of the multi-chamber single dose pack of FIG. 3, in a state subsequent to reattachment with a further multi-chamber single dose pack 130-6/130-7. The further single dose packs may originate as separate units, or they may originate as separate portions from other separable multi-chamber single dose packs. The further single dose packs may include the same or difference detergent wash compositions as compared with any of the wash compositions included in any of chambers 130-1 through 130-4. More specifically, the chambers (130) in the pack have been separated (detached) along the respective tear lines (140), and then reattached with the further single dose pack by pressing together the portions of the films (110, 120) where the adhesive (150) is illustrated. The adhesive in the reattached state is illustrated in FIGS. 5A, 5B, and 6 with reference numeral (160). For example, in FIGS. 5A and 5B, reattachment is shown with overlapping edges of first film (110), where the adhesive (160) is disposed, along with abutting chambers (130-1, 130-5), again where the adhesive (160) is disposed. In FIG. 6, reattachment is shown with overlapping edges of first film (110), where the adhesive (160) is disposed. The overlapping and/or abutting manner of reattachment will depend on the shape/configuration of each chamber (130) so reattached, along with the location of the adhesive on each respective chamber (130) so reattached.

Figure 7A:
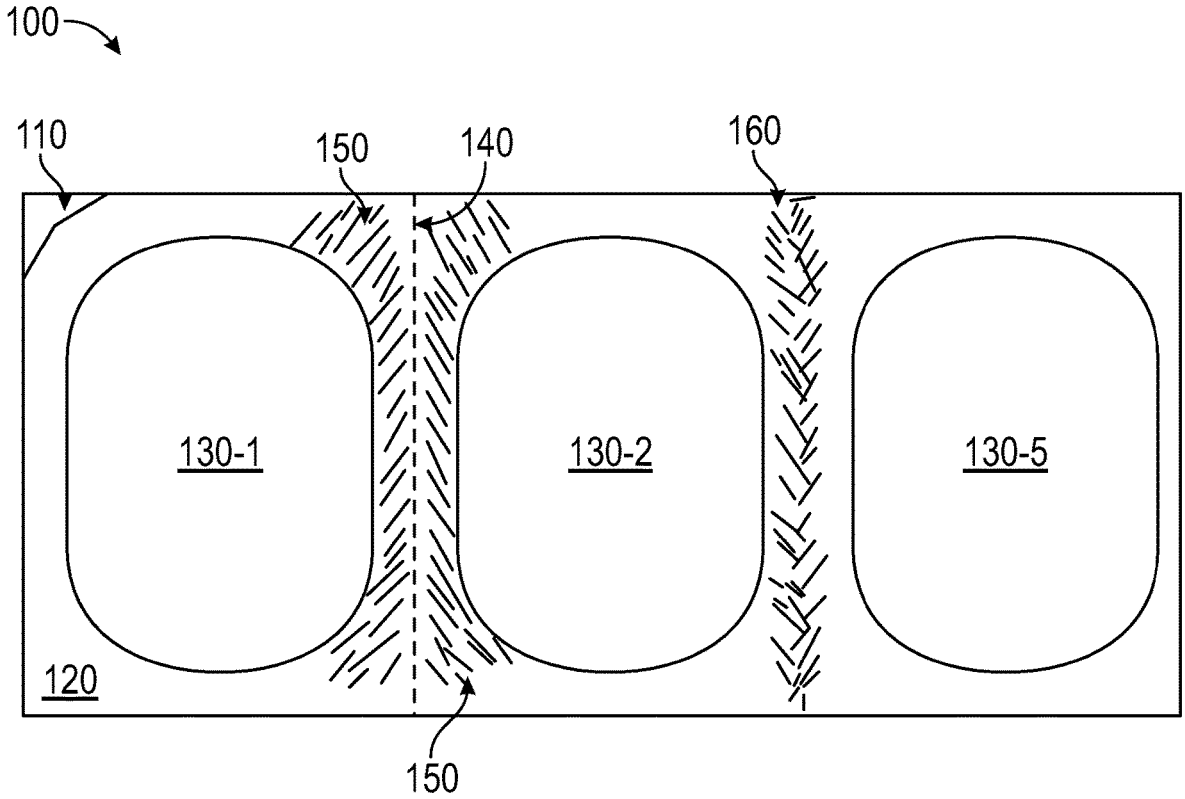
FIGS. 7A and 7B show plan and side views, respective, of both the first and second chambers of the multi-chamber single dose pack of FIGS. 1A and 1B, in a state subsequent to reattachment with a further chamber.
Figure 7B:
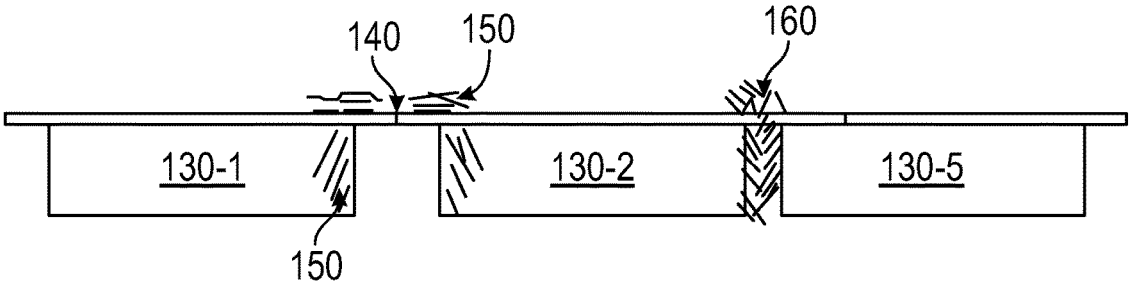

As will be appreciated, chambers may be detached from multiple original single dose packs (100), and reattached in any of numerous combinations, as required for the particular wash load scale or type of soiling. In this manner, numerous combinations of detergent wash composition volume and type may be realized. For example, FIGS. 7A and 7B show a combination of three chambers in a reattached single dose pack, wherein chambers (130-1, 130-2) originate from the embodiment shown in FIG. 1A, having not been detached, and chamber (130-5) may originate as an independent single dose pack, or having been separate from a further multi-chamber single dose pack. As thus can be appreciated, the present disclosure is not limited by the number or types of chamber that can be separated from one another or combined with one another to form the desired quantity and detergent type of single dose pack.

In any of the embodiments described above, the various chambers containing the detergent wash compositions may be provided in differing sizes, shapes, and/or colors. These differing sizes, shapes, and/or colors of a chamber may indicate different types of detergent wash compositions, for example including different main cleaning solvents or enzyme adapted for delivering different cleaning benefits, or including differing additives adapted for different types of fabrics such as linen softening agents, soil release agents, anti-redeposition agents, optical brighteners, dye transfer inhibiters, and/or water softeners, among others. As such, a consumer can pick one or more of the compartments that provide desirable functions and performances to make customized single dose packs for use, as described in greater detail below in connection with an exemplary method of use.

Method of Use

Using single dose packs as described above in FIGS. 1A-7B allows the consumer to prepare customized multi-chamber single dose packs. The consumer may be provided with, or obtain, a single dose pack including at least one chamber (or two, three, four, or more chambers) containing a first detergent wash composition. Such a single dose pack may be provided as shown, for example, in FIGS. 1A-1B for packs having two chambers separated by perforated tear line (140), or FIG. 3 for a pack having additional chambers. As noted above, the at least one chamber is formed by a first film and a second film attached to each other (110, 120), and a water-soluble adhesive is disposed along an outward-facing portion of either or both of the first and second films (150). The consumer may also be provided with, or obtain, a "supplemental" detergent wash composition delivery system can itself be provided in the form of a multi-chamber single dose pack (e.g., as in FIG. 3), for example including a first strip of water-soluble film, a second strip of water-soluble film adhered to the first strip of water-soluble film, and a plurality of compartments formed by the first and second strips of water-soluble film. The plurality of compartments may contain a second detergent wash composition that is the same or different than the first wash composition of the single dose pack. The supplemental wash composition delivery system may be provided with a plurality of weakened areas located between the compartments (such as perforated tear lines (140)) such that the weakened areas may be used to separate adjacent compartments without rupturing either adjacent compartment. The supplemental wash composition delivery system may be provided with the water-soluble adhesive. Accordingly, utilizing the single dose pack and the supplemental detergent wash composition deliver system, the consumer may form the customizable multi-chamber pack by detaching at least one compartment of the supplemental detergent wash composition delivery system by the weakened areas and attaching the at least one compartment to the single dose pack by pressing the at least one compartment to the single dose pack using the water-soluble adhesive disposed along the outward-facing portion of the single dose pack, thereby forming a customized multi-chamber single dose pack. The result of this procedure is illustrated, in various exemplary configurations, in FIGS. 5A-7B.

Water-Soluble Film Material

The film (110, 120) of the single-dose pack (100) is water soluble such that the film will completely dissolve when an exterior of the film is exposed to water, such as in a washing machine typically used for laundry or dishes. When the film (110, 120) dissolves, the pack (100) is ruptured and the contents, including the detergent wash composition, are released. As used herein, "water soluble" means at least 2 grams of the solute (the film in one example) will dissolve in 5 liters of solvent (water in one example,) for a solubility of at least 0.4 grams per liter (g/l), at a temperature of 25 degrees Celsius (° C.) unless otherwise specified. Suitable films for packaging are completely soluble in water at temperatures of about 5° C. or greater.

The film (110, 120) is desirably strong, flexible, and shock resistant during storage at both high and low temperatures and high and low humidities. In an exemplary embodiment, the film is initially formed from polyvinyl acetate, and at least a portion of the acetate functional groups are hydrolyzed to produce alcohol groups. Therefore, the film includes polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 70 to about 90 μm in various embodiments. The film may include alternate materials in some embodiments, such as methyl hydroxy propyl cellulose and polyethylene oxide, but the film is water soluble in all embodiments.

The wash composition is typically in direct contact with the film (110, 120) within the single dose pack (100). The film of the container is sealable by heat, heat and water, ultrasonic methods, or other techniques, and one or more sealing techniques may be used to enclose the wash composition within the chambers of the pack. In an exemplary embodiment, the single dose pack (including the film and the wash composition) has a weight of from about 15 to about 75 grams. In alternate embodiments, the single dose pack has a weight from about 15 to about 40 grams, or from about 17 to about 30 grams.

The film (110, 120) remains structurally sound and intact prior to use of the single dose pack (100), where the single dose pack is immersed in a large quantity of water in use. A "large" quantity of water is at least about 100 times the weight of the single dose pack. For example, a single dose pack having a weight of from about 5 to about 50 grams may be immersed in from about 5 to about 50 liters of water in use. As used herein, "structurally sound" means the pack and the film do not rupture or leak under typical storage conditions, such as about 0.5 to about 1.5 atmospheres of pressure, temperatures of about −10 to about 35° C., and a relative humidity of about 1 to about 80% for a period of at least 1 week.

Wash Composition—Detergent Surfactant

A plurality of components are combined to form a detergent wash composition, where the wash composition is typically prepared prior to encapsulation. The plurality of components includes at least one enzyme, a solvent system, at least one detergent surfactant, as well as various optional additives, as will be discussed in greater detail below.

The wash composition may include a detergent surfactant that is selected from the group consisting of: a nonionic surfactant, an anionic surfactant, a cationic surfactant, and mixtures of two or more thereof. Thus, in some embodiments, the wash composition may include an ionic detergent surfactant, where the ionic detergent surfactant is formulated for laundry in an exemplary embodiment. The ionic detergent surfactant may include one or more surfactants, including cationic and/or anionic surfactants, in various embodiments.

Suitable ionic detergent surfactants that are anionic include soaps which contain sulfate or sulfonate groups, including those with alkali metal ions as cations. Usable soaps include alkali metal salts of saturated or unsaturated fatty acids with 12 to 18 carbon (C) atoms. Such fatty acids may also be used in incompletely neutralized form. Usable ionic detergent surfactants of the sulfate type include the salts of sulfuric acid semi esters of fatty alcohols with 12 to 18 C atoms, and/or alcohol ethoxysulfates. Usable ionic detergent surfactants of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters, and lauryl ether sulfates.

Suitable ionic detergent surfactants that are cationic may include textile-softening substances of the general formula X, XI, or XII as illustrated below:

(X)

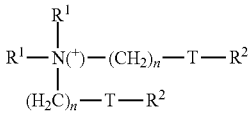

(XI)

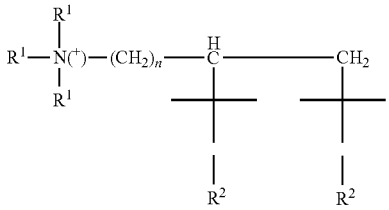

(XII)

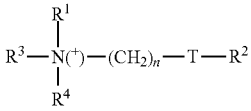

in which each $R^1$ group is mutually independently selected from among $C_{1-6}$ alkyl, alkenyl or hydroxyalkyl groups; each $R^2$ group is mutually independently selected from among $C_{8-28}$ alkyl or alkenyl groups; $R^3$═$R^1$ or $(CH_2)_n$-T-$R^2$; $R^4$═$R^1$ or $R^2$ or $(CH_2)_n$-T-$R^2$; T═$CH_2$—, —O—CO—, or —CO—O—, and n is an integer from 0 to 5. The ionic detergent surfactants that are cationic may include conventional anions of a nature and number required for charge balancing. Alternatively, the ionic detergent surfactant may include anionic detergent surfactants that may function to balance the charges with the cationic detergent surfactants. In some embodiments, ionic detergent surfactants that are cations may include hydroxyalkyltrialkylammonium compounds, such as $C_{12-18}$ alkyl(hydroxyethyl) dimethyl ammonium compounds, and may include the halides thereof, such as chlorides or other halides. The ionic detergent surfactants that are cations may be especially useful for compositions intended for treating textiles.

In some embodiments, the anionic surfactant is a polyethoxylated alcohol sulfate, such as those sold under the trade name CALFOAM® 303 (Pilot Chemical Company, California). Such materials, also known as alkyl ether sulfates (AES) or alkyl polyethoxylate sulfates, are those which correspond to the following formula (XIII):

(XIII)

wherein R' is a C8-C20 alkyl group, n is from 1 to 20, and M' is a salt-forming cation, preferably, R' is C10-C18 alkyl, n is from 1 to 15, and M' is sodium, potassium, ammonium, alkylammonium, or alkanolammonium. In another embodiment, R' is a C12-C16 alkyl, n is from 1 to 6 and M' is sodium. In another embodiment, the alkyl ether sulfate is sodium lauryl ether sulphate (SLES).

In some embodiments, the anionic surfactant can be linear alkylbenzene sulfonic acid (LAS) or a salt thereof, alkyl ethoxylated sulphate, alkyl propoxy sulphate, alkyl sulphate, or a mixture thereof. Linear alkylbenzenesulfonate (LAS) is a water soluble salt of a linear alkyl benzene sulfonate having between 8 and 22 carbon atoms of the linear alkyl group. The salt can be an alkali metal salt, or an ammonium, alkylammonium, or alkanolammonium salt. In one embodiment, the LAS comprises an alkali metal salt of $C_{10}$-$C_{16}$ alkyl benzene sulfonic acids, such as $C_{11}$-$C_{14}$ alkyl benzene sulfonic acids.

Suitable nonionic detergent surfactants include alkyl glycosides and ethoxylation and/or propoxylation products of alkyl glycosides or linear or branched alcohols in each case having 12 to 18 C atoms in the alkyl moiety and 3 to 20, or 4 to 10, alkyl ether groups. Corresponding ethoxylation and/or propoxylation products of N-alkylamines, vicinal diols, fatty acid esters and fatty acid amides, which correspond to the alkyl moiety in the stated long-chain alcohol derivatives, may furthermore be used. Alkylphenols having 5 to 12 C atoms may also be used in the alkyl moiety of the above described long-chain alcohol derivatives.

Examples of nonionic surfactants suitable for the present invention include, but are not limited to, polyalkoxylated alkanolamides, polyoxyalkylene alkyl ethers, polyoxyalkylene alkylphenyl ethers, polyoxyalkylene sorbitan fatty acid esters, polyoxyalkylene sorbitol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, amine oxide surfactants, alkoxylated fatty alcohols, or a mixture thereof. In some embodiments, the nonionic surfactant is alcohol ethoxylate (AE), alcohol propoxylate, or a mixture thereof. In other embodiments, the nonionic surfactant is AE.

The AE may be primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles, or from 3 to 8 moles of ethylene oxide per mole of alcohol.

Exemplary AEs are the condensation products of aliphatic $C_8$-$C_{20}$, preferably $C_8$-$C_{16}$, primary or secondary, linear or branched chain alcohols with ethylene oxide. In some embodiments, the alcohol ethoxylates contain 1 to 20, or 3 to 8 ethylene oxide groups, and may optionally be end-capped by a hydroxylated alkyl group.

In one embodiment, the AE has Formula (XIV):

$$R_2—(—O—C_2H_4—)_m—OH \quad \text{(XIV)}$$

wherein $R_2$ is a hydrocarbyl group having 8 to 16 carbon atoms, 8 to 14 carbon atoms, 8 to 12 carbon atoms, or 8 to 10 carbon atoms; and m is from 1 to 20, or 3 to 8.

The hydrocarbyl group may be linear or branched, and saturated or unsaturated. In some embodiments, $R_2$ is a linear or branched $C_8$-$C_{16}$ alkyl or a linear group or branched $C_8$-$C_{16}$ alkenyl group. Preferably, $R_2$ is a linear or branched $C_8$-$C_{16}$ alkyl, $C_8$-$C_{14}$ alkyl, or $C_8$-$C_{10}$ alkyl group. In case (e.g., commercially available materials) where materials contain a range of carbon chain lengths, these carbon numbers represent an average. The alcohol may be derived from natural or synthetic feedstock. In one embodiment, the alcohol feedstock is coconut, containing predominantly $C_{12}$-$C_{14}$ alcohol, and oxo $C_{12}$-$C_{15}$ alcohols.

Detergent surfactants may be present in the wash composition at a concentration of from about 1 to about 70 weight percent, or from about 5 to about 70 weight percent, or from about 1 to about 60 weight percent, or from about 5 to about 60 weight percent, or from about 10 to about 70 weight percent, or from about 10 to about 60 weight percent in various embodiments, based on the total weight of the wash composition. In other embodiment, detergent surfactants may be present in the wash composition at a concentration of from about 1 to about 10 weight percent, from about 10 to about 20 weight percent, from about 20 to about 30 weight percent, from about 30 to about 40 weight percent, from about 40 to about 50 weight percent, or from about 50 to about 60 weight percent, or from about 60 to about 70 weight percent, again based on the total weight of the wash composition.

Wash Composition—Enzyme

Possible enzymes that may be in the wash composition contemplated herein include one or more of a protease, amylase, mannanase, lipase, cutinase, carbohydrase, cellulase, pectinase, arabinase, galactanase, xylanase, oxidase, (e.g., a laccase), and/or peroxidase, but others are also possible. Of the foregoing enzymes, protease, amylase, mannanase are preferred in some embodiments of the present disclosure, and protease is particularly preferred in an embodiment. In general, the properties of the selected enzyme(s) should be compatible with the selected wash composition, (i.e., pH-optimum, compatibility with other enzymatic and non-enzymatic ingredients, etc.). The detergent enzyme(s) may be included in the wash composition by adding separate additives containing one or more enzymes, or by adding a combined additive comprising all the enzymes that are added to the wash composition. Suitable enzyme additives are solutions that are about 10% active, such as about 7% to about 13% active. In other embodiments, enzymes can be added in a powder form, such as in a granular form.

The enzyme may be present in the wash composition in effective amounts, such as from about 0.1 to about 5 weight percent of enzyme, or from about 0.5 to about 4 weight percent, or from about 1 to about 3 weight percent, based on the total weight of the wash composition, in various embodiments. In other embodiments, the enzyme is present within the wash composition in an amount of from about 0.1 to about 1 weight percent, about 1 to about 2 weight percent, about 2 to about 3 weight percent, about 3 to about 4 weight percent, or about 4 to about 5 weight percent.

Wash Composition—Solvent System

The wash composition of the present disclosure, in some embodiments, includes a solvent system, which may include water and/or a non-aqueous surfactant. Accordingly, water may be included in the wash composition at a concentration of up to about 30% total water, such as from about 5% to about 30% total water, from about 8% to about 25% total water, from about 5% to about 20% total water, from about 8% to about 20% total water, from about 5% to about 15% total water, or from about 8% to about 15% total water, by weight of the overall wash composition. In other embodiments, water is included in the wash composition at a concentration of about 5% to about 8%, about 8% to about 12%, about 12% to about 20%, or about 20% to about 30% total water, by weight of the overall wash composition. Water may be added to the wash composition directly or as a component of other ingredients, or directly and as a component of other ingredients.

In addition to the water, the wash composition may include non-aqueous solvents. For example, non-aqueous solvents that may be included in the wash composition are glycerin, propylene glycol, polyethylene glycol, and 4C+ compounds. The term "4C+ compound" refers to one or more of: polyethylene glycol; polypropylene glycol; polyethylene glycol esters such as polyethylene glycol stearate, propylene glycol laurate, and/or propylene glycol palmitate; methyl ester ethoxylate; diethylene glycol; dipropylene glycol; sorbitol; tetramethylene glycol; butylene glycol; pentanediol; hexylene glycol; heptylene glycol; octylene glycol; 2-methyl, 1,3 propanediol; xylitol; mannitol; erythritol; dulcitol; inositol; adonitol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl)methyl ammonium methylsulfate; ethylene oxide/propylene oxide copolymers with a number average molecular weight of 3,500 Daltons or less; and ethoxylated fatty acids. In some embodiments, preferred non-aqueous solvents for use in the present wash composition include glycerin, propylene glycol, and polyethylene glycol, with propylene glycol being particularly preferred in an embodiment.

The non-aqueous solvents may be included in the wash composition in an amount of from about 1% to about 30%, such as from about 5% to about 25%, or about 10% to about 20%, or about 1% to about 15%, or about 5% to about 15%, or about 10% to about 15%, by weight of the overall wash composition. In other embodiments, the non-aqueous solvents may be included in the wash composition in an amount of from about 1% to about 5%, or about 5% to about 10%, or about 10% to about 15%, or about 15% to about 20%, by weight of the overall wash composition.

Optionally, in some embodiments, carbohydrates may be included in the solvent blend. Suitable carbohydrates may alternatively or additionally include fructose, sucrose, xylitol, sorbitol, mannitol, erythritol, dulcitol, inositol, adonitol, tagatose, trehalose, galactose, rhamnose, cyclodextrin, maltodextrin, dextran, sucrose, ribulose, threose, arabinose, xylose, lyxose, allose, altrose, mannose, idose, lactose, maltose, invert sugar, isotrehalose, neotrehalose, palatinose or isomaltulose, erythrose, deoxyribose, gulose, idose, talose, erythrulose, xylulose, psicose, turanose, cellobiose, amylopectin, glucosamine, mannosamine, fucose, glucuronic acid, gluconic acid, glucono-lactone, abequose, galactosamine, beet oligosaccharides, isomalto-oligosaccharides, xylo-oligosaccharides, gentio-oligoscaccharides, sorbose, nigero-oligosaccharides, palatinose oligosaccharides, fucose, fractooligosaccharides, maltotetraol, maltotriol, malto-oligosaccharides, lactulose, melibiose, raffinose, rhamnose, ribose, coupling sugars, or soybean oligosaccharides, and a mixture thereof.

Wash Composition—Optional Components

Several other components may optionally be added to and included in the wash composition, including but not limited to preservatives, peroxy compounds, bleach activators, anti-redeposition agents, optical brighteners, foam inhibitors, chelators, bittering agents, dye transfer inhibitors, soil release agents, water softeners, and other components. A partial, non-exclusive list of additional components (not illustrated) that may be added to and included in the wash composition include electrolytes, pH regulators, graying inhibitors, anti-crease components, bleach agents, colorants, scents, and processing aids.

The wash composition includes one or more organic or inorganic preservatives. Suitable organic or inorganic acid-based preservatives include, but are not limited to, sorbic acid and benzoic acid. The organic or inorganic acid-based preservative may alternatively be provided in salt-of-acid form, for example sodium sorbate, sodium benzoate, potassium sorbate, or potassium benzoate. The organic or inorganic acid-based preservative may be included in the wash composition in an amount of about 0.01% to about 0.50%, such as about 0.02% to about 0.25%, or from about 0.05% to about 0.20%, by weight of the overall wash composition.

As alluded to above, a peroxy compound may optionally be present in the wash composition. Exemplary peroxy compounds include organic peracids or peracidic salts of organic acids, such as phthalimidopercaproic acid, perbenzoic acid or salts of diperdodecanedioic acid, hydrogen peroxide and inorganic salts that release hydrogen peroxide under the washing conditions, such as perborate, percarbonate and/or persilicate. Hydrogen peroxide may also be produced with the assistance of an enzymatic system, i.e. an oxidase and its substrate. Other possible peroxy compounds include alkali metal percarbonates, alkali metal perborate monohydrates, alkali metal perborate tetrahydrates or hydrogen peroxide. Peroxy compounds may be present in the wash composition at an amount of from about 0 to about 50 weight percent, or an amount of from about 3 to about 30 weight percent, or an amount of from about 3 to about 10 weight percent, based on the total weight of the wash composition, in various embodiments.

Bleach activators may optionally be added and included in the wash composition. Conventional bleach activators that form peroxycarboxylic acid or peroxyimidic acids under perhydrolysis conditions and/or conventional bleach-activating transition metal complexes may be used. The bleach activator optionally present may include, but is not limited to, one or more of: N- or O-acyl compounds, for example polyacylated alkylenediamines, such as tetraacetylethylenediamine; acylated glycolurils, such as tetraacetylglycoluril; N-acylated hydantoins; hydrazides; triazoles; urazoles; diketopiperazines; sulfurylamides and cyanurates; carboxylic anhydrides, such as phthalic anhydride; carboxylic acid esters, such as sodium isononanoylphenolsulfonate; acylated sugar derivatives, such as pentaacetyl glucose; and cationic nitrile derivatives such as trimethylammonium acetonitrile salts.

To avoid interaction with peroxy compounds during storage, the bleach activators may be coated with shell substances or granulated prior to addition to the wash composition, in a known manner. As such, the bleach activator and/or other components may be present in a liquid wash composition as a free or floating particulate. Exemplary embodiments of the coating or shell substance include tetraacetylethylenediamine granulated with the assistance of carboxymethylcellulose and having an average grain size of 0.01 mm to 0.8 mm, granulated 1,5-diacetyl-2,4-dioxohexahydro-1,3,5-triazine, and/or trialkylammonium acetonitrile formulated in particulate form. In various embodiments, the bleach activators may be present in the wash composition in quantities of from about 0 to about 8 weight percent, or from about 0 to about 6 weight percent, or from about 0 to about 4 weight percent, in each case relative to the total weight of the wash composition.

One or more anti-redeposition agents may also be optionally included in the wash composition. Anti-redeposition agents include polymers with a soil detachment capacity, which are also known as "soil repellents" due to their ability to provide a soil-repelling finish on the treated surface, such as a fiber. Anti-redeposition agents include polymers with a soil detachment capacity. One example in regard to polyesters includes copolyesters prepared from dicarboxylic acids, such as adipic acid, phthalic acid or terephthalic acid. In an exemplary embodiment, an anti-redeposition agents includes polyesters with a soil detachment capacity that include those compounds which, in formal terms, are obtainable by esterifying two monomer moieties, the first monomer being a dicarboxylic acid HOOC-Ph-COOH and the second monomer a diol HO—$(CHR^{11}—)_a$OH, which may also be present as a polymeric diol H—$(O—(CHR^{11}—)_a)_b$OH. Ph here means an ortho-, meta- or para-phenylene residue that may bear 1 to 4 substituents selected from alkyl residues with 1 to 22 C atoms, sulfonic acid groups, carboxyl groups and mixtures thereof. $R^{11}$ means hydrogen or an alkyl residue with 1 to 22 C atoms and mixtures thereof. "a" means a number from 2 to 6 and "b" means a number from 1 to 300. The polyesters obtainable therefrom may contain not only monomer diol units —O—$(CHR^{11}—)_a$O— but also polymer diol units —$(O—(CHR^{11}—)_a)_b$O—. The molar ratio of monomer diol units to polymer diol units may amount to from about 100:1 to about 1:100, or from about 10:1 to about 1:10 in another embodiment. In the polymer diol units, the degree of polymerization "b" may be in the range of from about 4 to about 200, or from about 12 to about 140 in an alternate embodiment. The average molecular weight of the polyesters with a soil detachment capacity may be in the range of from about 250 to about 100,000, or from about 500 to about 50,000 in an alternate embodiment. The acid on which the residue Ph is based may be selected from terephthalic acid, isophthalic acid, phthalic acid, trimellitic acid, mellitic acid, the isomers of sulfophthalic acid, sulfoisophthalic acid and sulfoterephthalic acid and mixtures thereof. Where the acid groups thereof are not part of the ester bond in the polymer, they may be present in salt form, such as an alkali metal or ammonium salt. Exemplary embodiments include sodium and potassium salts.

If desired, instead of the monomer HOOC-Ph-COOH, the polyester with a soil detachment capacity (the anti-redeposition agent) may include small proportions, such as no more than about 10 mole percent relative to the proportion of Ph with the above-stated meaning, of other acids that include at least two carboxyl groups. These include, for example, alkylene and alkenylene dicarboxylic acids such as malonic acid, succinic acid, fumaric acid, maleic acid, glutaric acid, adipic acid, pimelic acid, suberic acid, azelaic acid and sebacic acid. Exemplary diols HO—$(CHR^{11}—)_a$OH include those in which $R^{11}$ is hydrogen and "a" is a number of from about 2 to about 6, and in another embodiment includes those in which "a" has the value of 2 and $R^{11}$ is selected from hydrogen and alkyl residues with 1 to 10 C atoms, or where $R^{11}$ is selected from hydrogen and alkyl residues with 1 to 3 C atoms in another embodiment. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol. The polymeric diols include polyethylene glycol with an average molar mass in the range from about 1000 to about 6000. If desired, these polyesters may also be end group-terminated, with end groups that may be alkyl groups with 1 to 22 C atoms or esters of monocarboxylic acids. The end groups attached via ester bonds may be based on alkyl, alkenyl and aryl monocarboxylic acids with 5 to 32 C atoms, or with 5 to 18 C atoms in another embodiment. These include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselinic acid, petroselaidic acid, oleic acid, linoleic acid, linolaidic acid, linolenic acid, eleostearic acid, arachidic acid, gadoleic acid, arachidonic acid, behenic acid, erucic acid, brassidic acid, clupanodonic acid, lignoceric acid, cerotic acid, melissic acid, benzoic acid, which may bear 1 to 5 substituents having a total of up to 25 C atoms, or 1 to 12 C atoms in another embodiment, for example tert-butylbenzoic acid. The end groups may also be based on hydroxymonocarboxylic acids with 5 to 22 C atoms, which for example include hydroxyvaleric acid, hydroxycaproic acid, ricinoleic acid, the hydrogenation product thereof, hydroxystearic acid, and ortho-, meta- and para-hydroxybenzoic acid. The hydroxymonocarboxylic acids may in turn be joined to one another via their hydroxyl group and their carboxyl group and thus be repeatedly present in an end group. The number of hydroxymonocarboxylic acid units per end group, i.e. their degree of oligomerization, may be in the range of from 1 to 50, or in the range of from 1 to 10 in another embodiment. In an exemplary embodiment, polymers of ethylene terephthalate and polyethylene oxide terephthalate, in which the polyethylene glycol units have molar weights of from about 750 to about 5000 and the molar ratio of ethylene terephthalate to polyethylene oxide terephthalate of from about 50:50 to about 90:10, are used alone or in combination with cellulose derivatives. The anti-redeposition agent is present in the wash composition at an amount of from about 0 to about 3 weight percent, or an amount of from about 0 to about 2 weight percent, or an amount of from about 0 to about 1 weight percent, based on the total weight of the wash composition, in various embodiments.

Optical brighteners may optionally be included in the wash composition. Optical brighteners adsorb ultraviolet and/or violet light and re-transmit it as visible light, typically a visible blue light. Optical brighteners include, but are not limited to, derivatives of diaminostilbene disulfonic acid or the alkali metal salts thereof. Suitable compounds are, for example, salts of 4,4'-bis(2-anilino-4-morpholino-1,3,5-triazinyl-6-amino)stilbene 2,2'-disulfonic acid or compounds of similar structure which, instead of the morpholino group, bear a diethanolamino group, a methylamino group, an anilino group or a 2-methoxyethylamino group. Optical brighteners of the substituted diphenylstyryl type may furthermore be present, such as the alkali metal salts of 4,4'-bis(2-sulfostyryl)diphenyl, 4,4'-bis(4-chloro-3-sulfostyryl)diphenyl, or 4-(4-chlorostyryl)-4'-(2-sulfostyryl)diphenyl. Mixtures of the above-stated optical brighteners may also be used. Optical brighteners may be present in the wash composition at an amount of from about 0 to about 1 weight percent in some embodiments, but in other embodiments optical brighteners are present in an amount of from about 0.01 to about 0.5 weight percent, or an amount of from about 0.05 to about 0.3 weight percent, or an amount of from 0.005 to about 5 weight percent, based on the total weight of the wash composition.

Foam inhibitors may also optionally be included in the wash composition. Suitable foam inhibitors include, but are not limited to, soaps of natural or synthetic origin, which include an elevated proportion of $C_{18}$-$C_{24}$ fatty acids. Suitable non-surfactant foam inhibitors are, for example, organopolysiloxanes and mixtures thereof with microtine, optionally silanized silica as well as paraffins, waxes, microcrystalline waxes and mixtures thereof with silanized silica or bis-fatty acid alkylenediamides. Mixtures of different foam inhibitors may also be used, for example mixtures of silicones, paraffins or waxes. In an exemplary embodiment, mixtures of paraffins and bistearylethylenediamide may be used. The wash composition may include the foam inhibitor at an amount of from about 0 to about 5 weight percent, but in other embodiments the foam inhibitor may be present at an amount of from about 0.05 to about 3 weight percent, or an amount of from about 0.5 to about 2 weight percent, based on the total weight of the wash composition.

Chelators bind and remove calcium, magnesium, or other metals from water, and may optionally be included in the wash composition. Many compounds can be used as water softeners, including but not limited to ethylenediaminetetraacetic acid (EDTA), nitrilotriacetic acid, diethylenetriaminepenta(methylenephosphonic acid), nitrilotris(methylenephosphonic acid), 1-hydroxyethane-1,1-diphosphonic acid, iminodisuccinic acid (IDS), or other chelating agents. Chelators may be present in the wash composition at an amount of from about 0 to about 5 weight percent in an exemplary embodiment, but in alternate embodiments the chelators are present at an amount of from about 0.01 to about 3 weight percent or an amount of from about 0.02 to about 1 weight percent, based on the total weight of the wash composition.

Bittering agents may optionally be added to hinder accidental ingestion of the single dose pack or the wash composition. Bittering agents are compositions that taste bad, so children or others are discouraged from accidental ingestion. Exemplary bittering agents include denatonium benzoate, aloin, and others. Bittering agents may be present in the wash composition at an amount of from about 0 to about 1 weight percent, or an amount of from about 0 to about 0.5 weight percent, or an amount of from about 0 to about 0.1 weight percent in various embodiments, based on the total weight of the wash composition.

The components of the wash composition are combined and mixed together with a mixer. Once mixed, the wash composition is encapsulated in the film, as described above. The components of the wash composition may all be mixed at one time, or different components may be pre-mixed and then combined. A wide variety of mixers may be used in alternate embodiments, such as an agitator, an in-line mixer, a ribbon blender, an emulsifier, and others. The wash composition is placed in one or more chambers of the container. Then, the film of the container is sealed with a sealer, where the sealer may utilize heat, water, ultrasonic techniques, water and heat, pressure, or other techniques for sealing the container and forming the multi-chamber single dose pack.

As such, the present disclosure has provided single dose wash compositions, contained within multi-chamber single dose packs, that realize an improved functionality in terms of scalability to the size of the wash load and customizability to the type of soil removal appropriate to the wash load. The individual chambers of the multi-chamber single dose packs are detachable from one another and also reattachable to one another in multiple combinations of two, three, or more chambers. The chambers may originate from one or more detached chambers of various multi-chamber single dose packs. Accordingly, more of fewer chambers may be utilized, as appropriate to the size of a particular wash load. Moreover, in the event that the individual chambers contain different detergents that are designed for particular soil removal applications, chambers may be detached where a particular soil removal functionality is not required or reattached wherein a particular soil removal functionality is desired.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A multi-chamber single dose pack comprising:
- a first water-soluble film;
- a second water-soluble film adhered to the first film;
- a first chamber and second chamber formed by the first film and the second film;
- a first detergent wash composition in the first chamber;
- a second detergent wash composition in the second chamber;
- a perforated tear line between the two chambers allowing separation of the two chambers by hand without opening either chamber; and
- a water-soluble adhesive disposed along an outward-facing portion of either or both of the first and second films, wherein the water-soluble adhesive is configured to allow the attachment of at least one further chamber including a further wash composition, and wherein the water-soluble adhesive adjoins the first chamber to the second chamber or the at least one further chamber thereby forming the multi-chamber single dose pack.

2. The single dose pack of claim 1, wherein the water-soluble adhesive is a pressure-sensitive adhesive thereby allowing reattachment of the two chambers by pressing together the two chambers at the outward-facing portion.

3. The single dose pack of claim 1, wherein the water-soluble adhesive is derived from a natural polymer.

4. The single dose pack of claim 1, wherein the water-soluble adhesive is derived from a synthetic polymer.

5. The single dose pack of claim 1, wherein the outward-facing portion comprises a portion of the first water-soluble film adjacent to the tear line.

6. The single dose pack of claim 1, wherein the outward-facing portion comprises a portion of the second water-soluble film forming either the first or second chamber.

7. The single dose pack of claim 1, wherein the first and second detergent wash compositions comprise the same detergent wash composition.

8. The single dose pack of claim 1, wherein the first and second detergent wash compositions comprise different wash compositions, and wherein the first wash composition is adapted for a first type of soil removal and the second wash composition is adapted for a second type of soil removal.

9. The single dose pack of claim 1, further comprising a third chamber formed between the first and second films, the third chamber comprising a third detergent wash composition.

10. The single dose pack of claim 1, wherein each of the first and second detergent wash compositions individually comprise: a solvent system, a detergent surfactant, and an enzyme.

11. A method of preparing customized multi-chamber single dose packs, comprising:
- providing a single dose pack comprising:
  - at least one chamber containing a first detergent wash composition, wherein the at least one chamber is formed by a first film and a second film attached to each other; and a water-soluble adhesive disposed along an outward-facing portion of either or both of the first and second films;

providing a supplemental wash composition delivery system comprising:

a first strip of water-soluble film;

a second strip of water-soluble film adhered to the first strip of water-soluble film;

a plurality of compartments formed by the first and second strips of water-soluble film, the plurality of compartments containing a second detergent wash composition; and a plurality of weakened areas located between the compartments such that the weakened areas may be used to separate adjacent compartments without rupturing either adjacent compartment;

detaching at least one compartment of the supplemental wash composition delivery system by the weakened areas; and attaching the at least one compartment to the single dose pack by pressing the at least one compartment to the single dose pack using the water-soluble adhesive disposed along the outward-facing portion of the single dose pack, thereby forming a customized multi-chamber single dose pack.

12. The method of claim 11, wherein the single dose pack comprises two, three, or four chambers.

13. The method of claim 12, wherein each of the two, three, or four chambers contain the same or different detergent wash compositions.

14. The method of claim 12, wherein the chambers of the single dose pack are divided and separable by perforated tear lines.

15. The method of claim 11, wherein the supplemental wash composition delivery system is a second single dose pack.

16. The method of claim 15, wherein the plurality of compartments of the second single dose pack are separated from each other by perforated tear lines along common films.

17. The method of claim 16, wherein a water-soluble adhesive is disposed along the perforated tear lines.

18. A multi-chamber single dose pack comprising:

a first chamber comprising a first water-soluble film, a second water-soluble film adhered to the first film, and a first detergent wash composition in the first chamber;

a second chamber comprising a third water-soluble film, a fourth water-soluble film adhered to the third film, and a second detergent wash composition in the second chamber; and a water-soluble adhesive disposed along an outward-facing portion of any of the first, second, third, or fourth films, wherein the water-soluble adhesive adjoins the first chamber to the second chamber thereby forming the multi-chamber single dose pack.

19. The multi-chamber single dose pack of claim 18, further comprising a third chamber comprising a fifth water-soluble film, a sixth water-soluble film adhered to the fifth film, and a third detergent wash composition in the third chamber, wherein the water-soluble adhesive adjoins the third chamber to either or both of the first and second chambers thereby forming a three-chamber single dose pack.

20. The multi-chamber single dose pack of claim 18, wherein the water-soluble adhesive is a pressure-sensitive adhesive thereby allowing adjoinment of the two chambers by pressing together the two chambers at the outward-facing portion.

* * * * *